US011447318B2

(12) United States Patent
Davis

(10) Patent No.: US 11,447,318 B2
(45) Date of Patent: Sep. 20, 2022

(54) WAX RING TRAY AND METHOD OF USE

(71) Applicant: Oatey Co., Cleveland, OH (US)

(72) Inventor: Alexander Lee Davis, Mentor, OH (US)

(73) Assignee: OATEY CO., Cleveland, OH (US)

( * ) Notice: Subject to any disclaimer, the term of this patent is extended or adjusted under 35 U.S.C. 154(b) by 0 days.

(21) Appl. No.: 17/331,970

(22) Filed: May 27, 2021

(65) Prior Publication Data

US 2021/0380320 A1 Dec. 9, 2021

Related U.S. Application Data

(60) Provisional application No. 63/034,272, filed on Jun. 3, 2020.

(51) Int. Cl.
*B65D 75/36* (2006.01)
*B65D 85/02* (2006.01)

(52) U.S. Cl.
CPC ..... *B65D 75/366* (2013.01); *B65D 85/02* (2013.01)

(58) Field of Classification Search
CPC ..... B65D 75/32; B65D 75/36; B65D 75/366; B65D 85/02
USPC ..... 206/6.1, 303.493, 566
See application file for complete search history.

(56) References Cited

U.S. PATENT DOCUMENTS 2,643,661 A * 6/1953 Shanahan, Jr. ..... G04D 3/083 206/303
3,214,010 A * 10/1965 Sunshine ..... B65D 75/32 206/303
3,351,186 A * 11/1967 Harris ..... A47F 7/03 206/6.1

* cited by examiner

*Primary Examiner* — Bryon P Gehman
(74) *Attorney, Agent, or Firm* — BakerHostetler

(57) ABSTRACT

A wax ring tray configured to store a wax ring therein includes a base, a first flexible member and a second flexible member. The first and second flexible members are positioned radially outward from a center of the base, and extend from the base to respective first and second ends. The first flexible member and the second flexible member are configured to transition between respective first positions and second positions. In the first position of the first flexible member, the first end of the first flexible member is positioned radially outward relative to the first end in the second position. In the first position of the second flexible member, a second end of the second flexible member is positioned radially outward relative to the second end of the second flexible member in the second position.

16 Claims, 11 Drawing Sheets

WAX RING TRAY AND METHOD OF USE

CROSS-REFERENCE TO RELATED APPLICATIONS

The present application claims priority to U.S. Provisional Application No. 63/034,272, filed Jun. 3, 2020. The contents of that application are hereby incorporated in their entirety by reference.

TECHNICAL FIELD

This disclosure relates generally to a wax ring tray and a method of removing a wax ring from the wax ring tray.

BACKGROUND

Wax rings are mounted between an underside of a toilet base and a flange attached to a waste line in the floor. Wax rings provide an impermeable barrier that keeps flushed sewage matter from splashing and seeping onto the floor.

Wax rings are sticky and can be difficult to remove from packaging. Conventional wax rings are boxed in cardboard and come wrapped in wax paper or rigid plastic. An installer having to remove the wax rings from the packaging has to pry the wax ring out of the packaging, which can cause damage to the wax ring and can result in wax covering the installer's hands. Therefore, there is a need for improved packaging for wax rings and an improved method for facilitating removal of the wax ring from packaging.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The foregoing needs are met, to a great extent, by the wax ring tray disclosed in the present application. The wax ring tray eliminates outer cardboard packaging and the need for an installer to touch the wax. The wax ring tray includes flexible members that are configured to release the wax ring from the tray. Additionally, the wax ring can include an ingredient that helps prevent the rings from sticking to the tray.

An aspect of the present disclosure provides a wax ring tray configured to store a wax ring therein. The wax ring tray comprises a base, a first flexible member, and a second flexible member. The base has an upper surface and an opposing lower surface. The first flexible member is positioned radially outward from a center of the base and extends at least partially in a first direction from the upper surface of the base to a first end. The first flexible member defines a first cavity that has a first opening defined by the lower surface of the base. The second flexible member is positioned radially outward from the center of the base and extends at least partially in the first direction from the upper surface of the base to a second end. The second flexible member defines a second cavity that has a second opening defined by the lower surface of the base. The first flexible member and the second flexible member are configured to transition between respective first positions and second positions. In the first position of the first flexible member, the first end is positioned radially outward relative to the first end of the first flexible member in the second position. In the first position of the second flexible member, the second end is positioned radially outward relative to the second end of the second flexible member in the second position. In the second positions of the first and second flexible members, the wax ring tray is configured to release the wax ring.

An alternative aspect of the present disclosure provides a packaging kit. The packaging kit comprises a wax ring and the wax ring tray configured to store the wax ring therein. The first flexible member and the second flexible member are configured to transition between a first position and a second position. In the first position of the first and second flexible members, the wax ring is retained within the wax ring tray, and in the second position of the first and second flexible members, the wax ring is released from the wax ring tray.

Another aspect of the present disclosure provides a method of removing a wax ring from the wax ring tray. The method comprises: transitioning the first flexible member from the first position to the second position; and transitioning the second flexible member from the first position to the second position. The method can further comprise: inserting a first finger into the first cavity of the first flexible member; inserting a second finger into the second cavity of the second flexible member; applying a first force by the first finger to the first flexible member within the first cavity in a radially inward direction to transition the first flexible member from the first position to the second position; and applying a second force by the second finger to the second flexible member within the second cavity in a radially inward direction to transition the second flexible member from the first position to the second position.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1A:
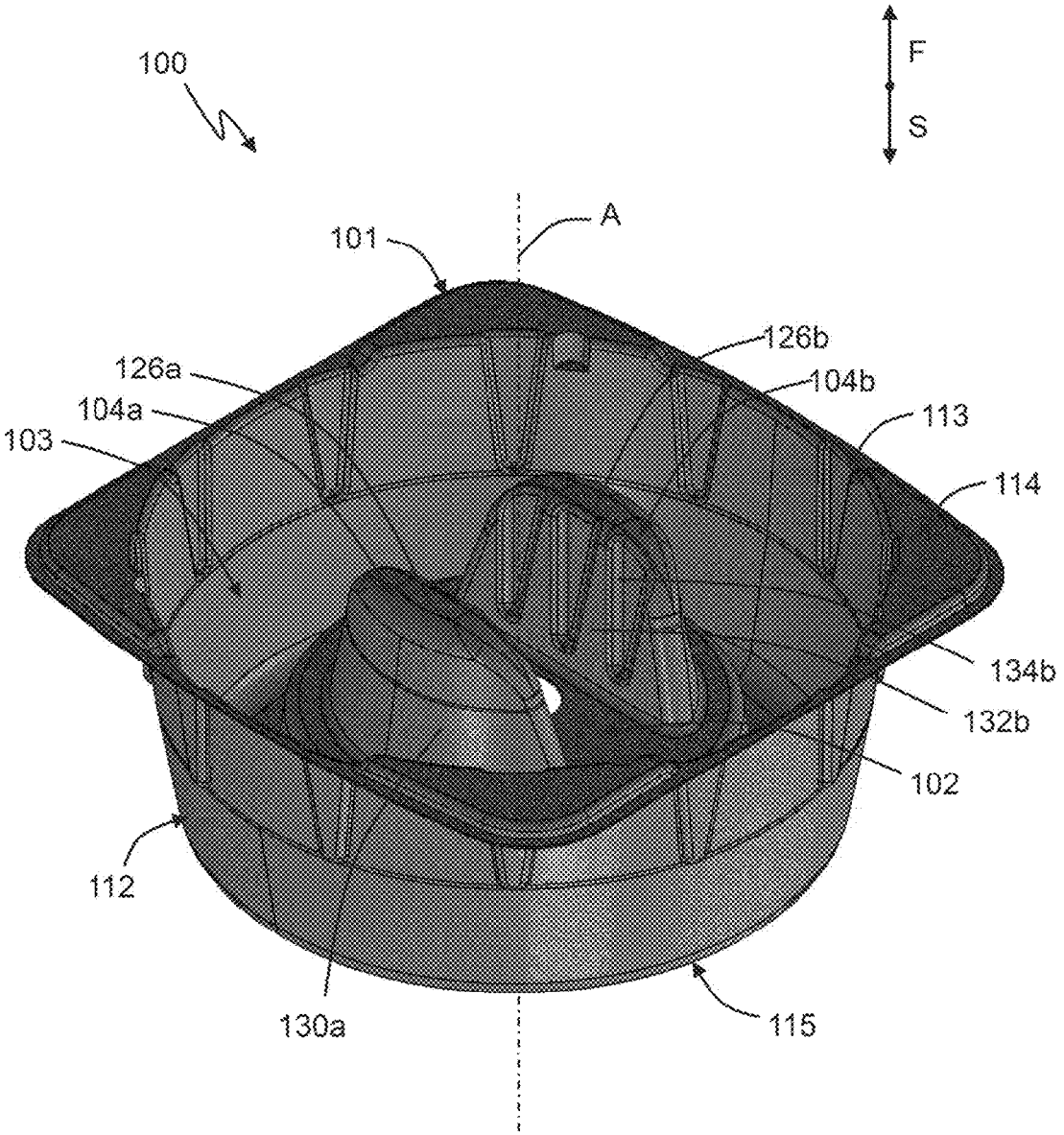
FIG. 1A illustrates a first top perspective view of a wax ring tray, according an aspect of this disclosure.

A wax ring tray configured to package and store a wax ring therein is disclosed. Wax rings are used for creating a seal between a toilet and a floor, and can be sticky, making them difficult to get off of an installer's hands. The wax ring tray disclosed herein is configured to release the wax ring with minimal or no contact with the wax ring during removal from the tray. The wax ring tray includes at least two flexible members configured to radially flex. The flexible members are positioned within a center of the tray, such that the wax ring can be positioned radially outward from the flexible members. As the members flex radially inward, contact between the tray and the wax ring is reduced, thereby releasing the wax ring from the tray. The flexible members can be actuated, or flexed, without contacting the wax ring. Additionally, the wax ring tray and/or the wax ring can include an ingredient that minimizes adhesion of the wax ring to the wax ring tray.

Certain terminology used in this description is for convenience only and is not limiting. The words "axial", "radial", "outward", "inward", "upper," and "lower" designate directions in the drawings to which reference is made. The term "substantially" is intended to mean considerable in extent or largely but not necessarily wholly that which is specified. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

Figure 1B:
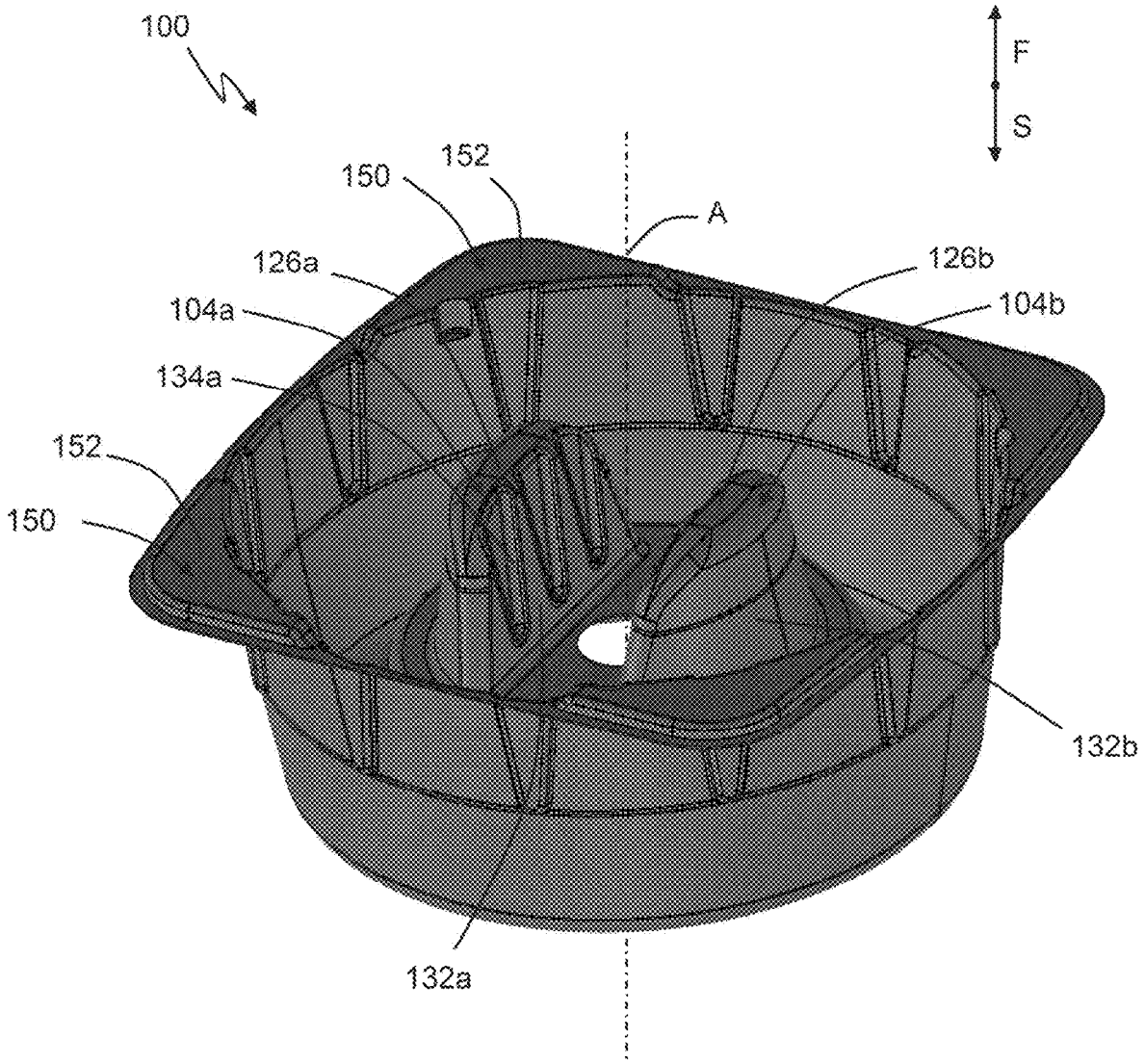
FIG. 1B illustrates a second top perspective view of the wax ring tray shown in FIG. 1, according an aspect of this disclosure.
Figure 2:
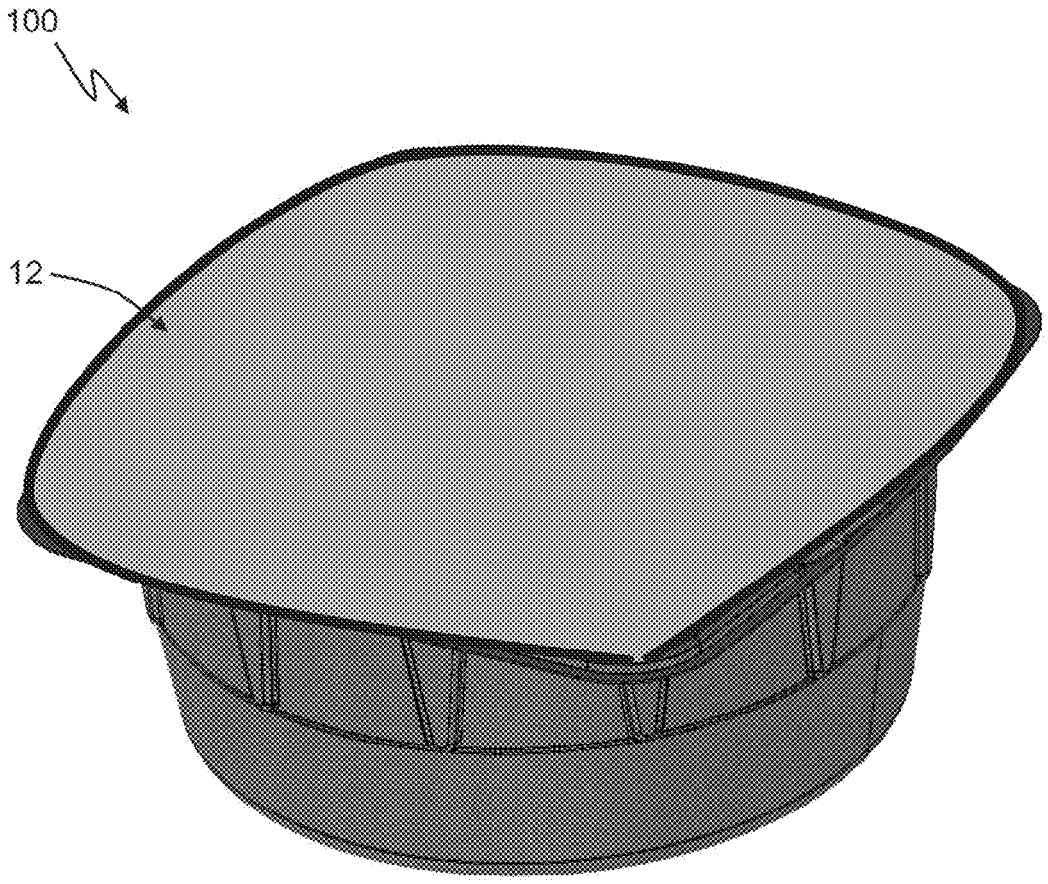
FIG. 2 illustrates a top perspective view of the wax ring with a lid, according to an aspect of this disclosure.
Figure 3:
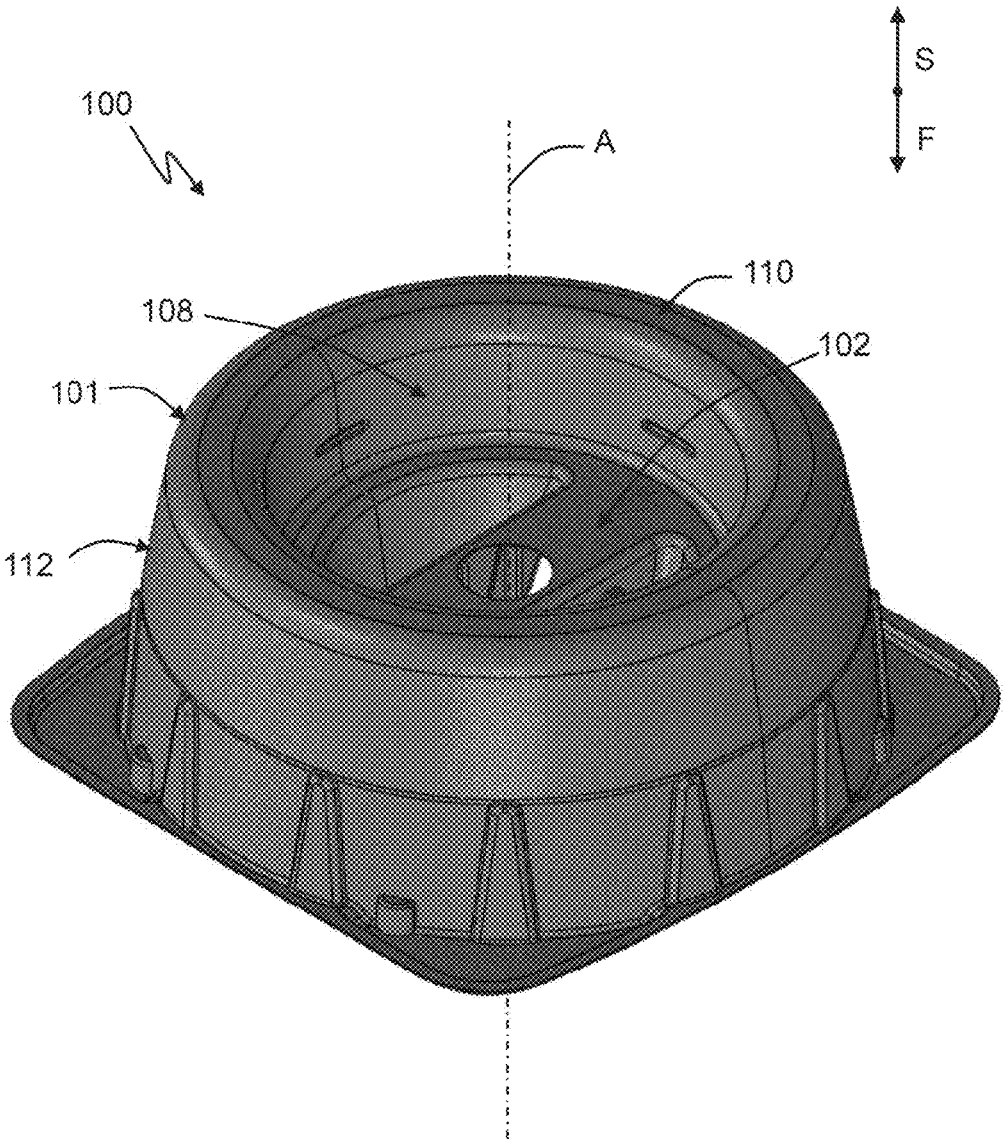
FIG. 3 illustrates a bottom perspective view of the wax ring tray shown in FIG. 1, according to an aspect of this disclosure.

FIGS. 1A, 1B, 2, and 3 illustrate a first top perspective view, a second top perspective view, a third top perspective view, and a bottom perspective view of a wax ring tray 100, respectively, according to aspects of this disclosure. The wax ring tray 100 is sized and configured to hold a wax ring 10 therein (see FIG. 9). With reference to FIG. 2, the wax ring tray 100 includes a lid 12 to seal and retain the wax ring 10 within. In an aspect, the wax ring tray 100 and lid 12 may comprise a blister-type pack. The wax ring 10 may be removed from the wax ring tray 100 by removing the lid 12 and accessing the wax ring 10 within, as will be discussed in greater detail below.

The wax ring 10 can include a wax sealing ring configured to mount between an underside of a base of a toilet and a flange attached to a waste line in the floor. The wax ring 10 may comprise a wax or a wax-like material. It will be appreciated that the wax ring 10 may also include a rubber or a rubber-like material, or other type of pliable material, that is configured to form a tight seal between the toilet and waste line to substantially prevent any fluid and/or material from leaking. In an aspect, the wax ring 10 includes substances that can substantially reduce sticking between the wax ring 10 and the wax ring tray 100.

The wax ring tray 100 includes a body 101 that comprises a base 102, a first flexible member 104*a*, a second flexible member 104*b*, an inner wall 108, a bottom wall 110, and an outer wall 112. The outer wall 112 at least partially defines an interior 103 of the wax ring tray 100 that has a generally cylindrical shape. The interior 103 is elongate along a central axis A of the wax ring tray 100, which extends centrally through the tray 100, from a tray opening 113 at a first end 114 (e.g. upper end) to a second end 115 (e.g. lower end). The interior 103 is configured to hold the wax ring 10 within, as further described below.

The body 101 may be formed as a single unitary piece, such that the base 102, first and second flexible members 104*a* and 104*b*, the inner wall 108, the bottom wall 110, and the outer wall 112 are all integrally formed together. For example, the body 101 may be formed by thermoforming, injection molding, or other process used for manufacturing packaging. The wax ring tray 100 may comprise different types of polymers, such as, for example, a homopolymer polypropylene or a homopolymer polypropylene polymer blend, including PVC, PVDC, PCTFE, COP, combinations thereof, or still other polymers. In an aspect, the body 101 comprises a frosted appearance (e.g. at least partially opaque).

Figure 4:
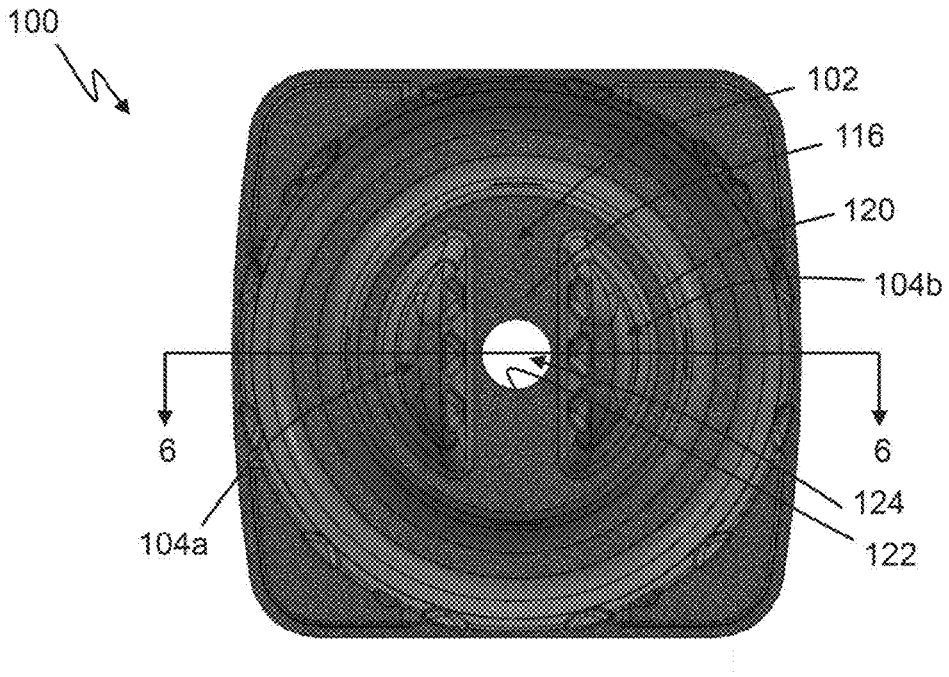
FIG. 4 illustrates a top view of the wax ring tray shown in FIG. 1, according an aspect of this disclosure.
Figure 5:
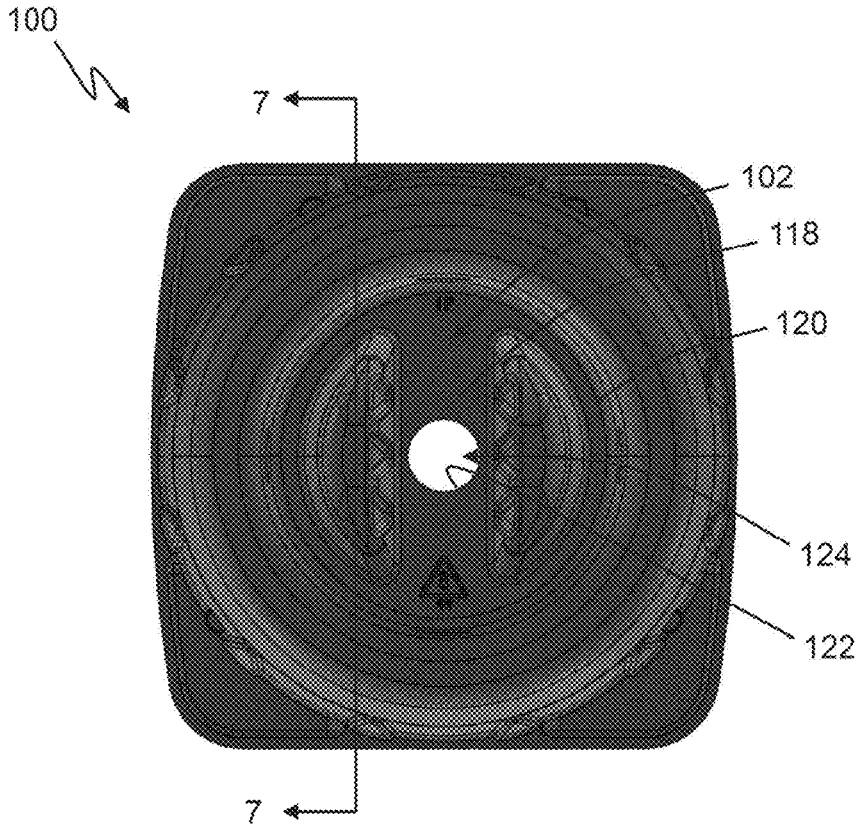
FIG. 5 illustrates a bottom view of the wax ring tray shown in FIG. 1, according to an aspect of this disclosure.

FIG. 4 illustrates a top view of the wax ring tray 100, and FIG. 5 illustrates a bottom view of the wax ring tray 100, according to aspects of this disclosure. The base 102 has an upper surface 116 and an opposing lower surface 118. The upper and lower surfaces 116 and 118 extend radially outward from the central axis A to an outer periphery 120. In an aspect, the base 102 includes an inner edge 122 that defines a central opening 124. The inner edge 122 extends substantially circumferentially about the central axis A. The interior 103 of the wax ring tray 100 opens to an exterior of the tray 100 through the central opening 124 and the tray opening 113. The interior 103 is configured to receive the wax ring 10 through the tray opening 113, and the central opening 124 is configured to vent heat and/or prevent pressure build-up within the interior 103.

The base 102 includes the first and second flexible members 104*a* and 104*b* extending at least partially in a first direction F (e.g. upward direction) from the upper surface 116. The first direction F is substantially parallel to the central axis A. The first and second flexible members 104*a* and 104*b* extend from the upper surface 116 to respective first and second ends 126*a* and 126*b* (see FIGS. 1A and 1B). In an aspect, the first and second ends 126*a* and 126*b* are located at or below the upper end 114 of the outer wall 112 in the first direction F, such that the first and second flexible members 104*a* and 104*b* are positioned substantially within the interior 103 of the tray 100. The first and second flexible members 104*a* and 104*b* may be integrally formed with the base 102, such that the base 102 and the first and second flexible members 104*a* and 104*b* form a single unitary structure. Alternatively, the first and second flexible members 104*a* may be connected to the base surface 102 by, for example, glue or other adhesive, a snap-fit or other similar connection, or still other type of connection.

The first and second flexible members 104*a* and 104*b* are spaced radially outward from the central axis A. In an aspect, the first flexible member 104*a* radially opposes the second flexible member 104*b*. This configuration of the first flexible member 104*a* relative to the second flexible member 104*b* may be referred to as a saddle-type configuration. The wax ring tray 100 may include two or more flexible members. For example, the wax ring tray 100 may include 2 or more flexible members extending from the base 102. In an aspect, the wax ring tray 100 includes an even number of flexible members, with each flexible member comprising a pair of flexible members such that each member is positioned to radially oppose the other member of the pair.

Figure 6:
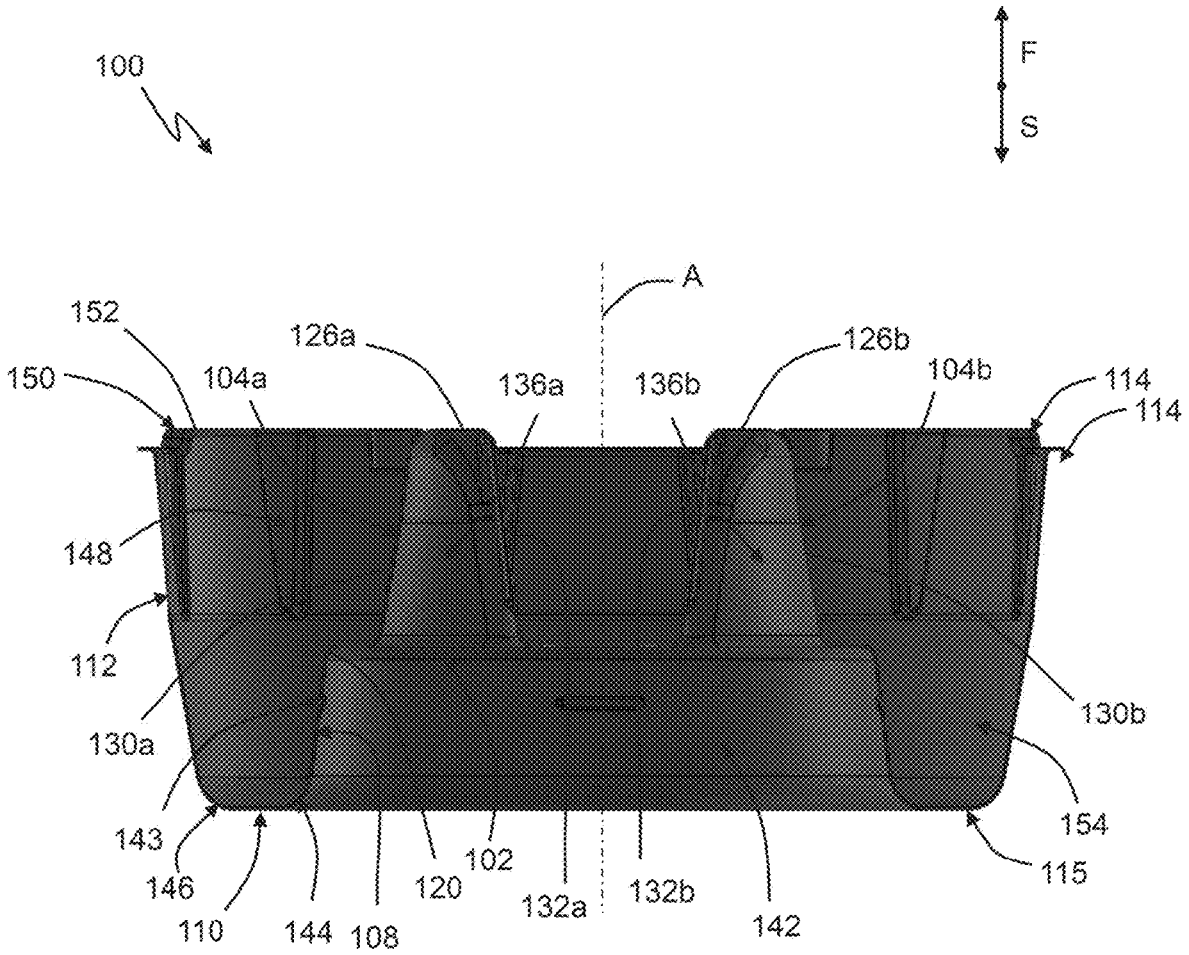
FIG. 6 illustrates a cross-sectional view of a side of the wax ring tray shown in FIG. 1 taken along line 6-6 of FIG. 4.

FIG. 6 illustrates a cross-sectional view of a side of the wax ring tray 100 taken along line 6-6 of FIG. 4. With reference to FIGS. 1A, 1B, and 6, the first flexible member 104*a* includes a first outer member surface 130*a* and a first inner member surface 132*a*. The first outer member surface 130*a* is located radially outward from the first inner member surface 132*a*, and extends approximately circumferentially about the central axis A. In an aspect, the first outer member surface 130*a* may extend from the base 102 toward the first end 126*a* at an angle (e.g. a taper) relative to the first direction F. For example, a portion of the first outer member surface 130*a* located at or near the base 102 can be located radially outward from the central axis A relative to a portion of the first outer member surface 130*a* located at or near the first end 126*a*. In an aspect, the angled first outer member surface 130*a* extending from the base 102 toward the first end 126*a* forms a partially conical shape.

The first inner member surface 132*a* is spaced apart from the central axis A. It will be appreciated that the first inner member surface 132*a* may be flat, curved, or combinations of flat and curved portions, and may include protrusions and or recesses as further described below. The first inner member surface 132*a* may extend substantially parallel to the central axis A. In an alternative aspect, the first inner member surface 132*a* may extend at an angle relative to the central axis A. For example, a portion of the first inner member surface 132*a* at or near the base 102 can be located radially inward from the central axis A relative to a portion of the first inner member surface 132*a* located at or near the first end 126*a*. An angled first inner member surface 132*a* can increase a flex distance of the first flexible member 104*a* during release of the wax ring 10.

The first inner member surface 132*a* may also define one or more structural support elements 134*a*. The structural support elements 134*a* may include recesses and/or protrusions formed on the first inner member surface 132*a*, or may include components attached or connected to the first inner member surface 132*a*. The structural support elements 134*a* are configured to provide structural support to the first flexible member 104*a* so that the first flexible member 104*a* maintains a rigidity before, during, and after the release of the wax ring 10. As illustrated, the structural support elements 134*a* include three substantially triangular recesses spaced along the first inner member surface 132*a*. The structural support elements 134*a* may include fewer or more recesses, and may include other shapes such as, for example, rectangular, circular, hexagonal, or still other shapes. In an alternative aspect, the first inner member surface 132*a* may not include any structural support elements 134*a*, such that the first inner member surface 132*a* forms a substantially flush surface. It will be appreciated that the first outer member surface 130*a* may include structural support elements configured substantially similar to the structural support elements 134*a* as described above.

Figure 7:
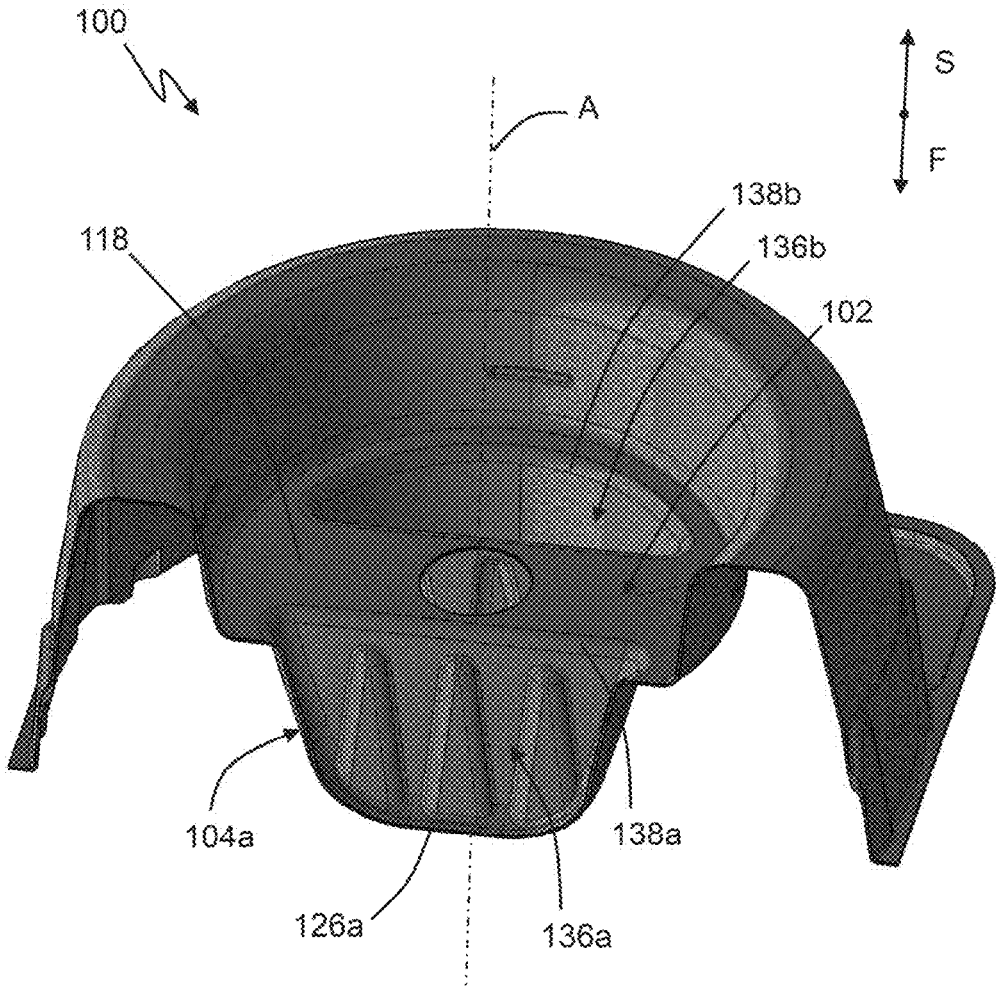
FIG. 7 illustrates a perspective view of a cross-section of the wax ring tray shown in FIG. 1 taken along line 7-7 of FIG. 5.

FIG. 7 illustrates a perspective view of a cross-section of the wax ring tray 100 taken along line 7-7 of FIG. 5. The first flexible member 104*a* defines a first cavity 136*a* that has a first opening 138*a* defined by the lower surface 118 of the base 102. The first cavity 136*a* can extend from the lower surface 118 up to the first end 126*a*. In an aspect, the first cavity 136*a* is fully enclosed by the first flexible member 104*a* with no apertures except for the first opening 138*a*. Alternatively, the first flexible member 104*a* may include one or more apertures that extend through the first flexible member 104*a* from the first cavity 136*a* to the interior 103 of the tray 100.

It will be appreciated that the first flexible member 104*a* and the second flexible member 104*b* can be configured substantially similarly; accordingly, the same reference numbers will be used herein with reference to corresponding components and features of the first and second flexible members 104*a* and 104*b*. As such, the second flexible member 104*b* includes a second outer member surface 130*b*, a second inner member surface 132*b*, structural support elements 134*b*, a second cavity 136*b*, and a second opening 138*b*. In an aspect, the first flexible member 104*a* and the second flexible member 104 form mirror images of each other relative to the central axis A, such that both the first inner member surface 132*a* and the second inner member surface 132*b* face radially inward toward each other. Alternatively, the first flexible member 104*a* may include a configuration that is different than a configuration of the second flexible member 104*b*.

With reference to FIG. 6, the inner wall 108 extends from the outer periphery 120 of the base 102 at least partially in a second direction S (e.g. downward direction). The second direction S opposes the first direction F. A transition between the outer periphery 120 of the base and the inner wall 108 may have a curved shape. The inner wall 108 extends substantially circumferentially about the outer periphery 120 forming an outer cavity 142. The outer cavity 142 is defined by the base 102 and the inner wall 108, and extends from the base 102 to the second end 115 of the tray 100. The inner wall 108 may extend at an angle relative to the central axis A, thereby forming a conical shaped wall. Alternatively, the inner wall 108 may extend substantially parallel to the central axis A, thereby forming a substantially cylindrically shaped wall.

The inner wall 108 may include one or more retaining elements 143. The retaining element 143 may comprise a recess and/or a protrusion defined by the inner wall 108, and/or a separate element attached or coupled to the inner wall 108. The retaining element 143 is located on the interior 103 side of the tray 100, and may be positioned on the inner wall 108 between the base 102 and the bottom wall 110. In an aspect, the retaining element 143 is positioned closer to the base 102 in the first direction F than to the bottom wall 110.

The bottom wall 110 extends at least partially radially outward (e.g. third direction) from an outer periphery 144 of the inner wall 108. The third direction is substantially perpendicular to the first and second directions F and S. A transition between the outer periphery 144 of the inner wall 108 and the bottom wall 110 may have a curved shape. In an aspect, the bottom wall 110 extends in the third direction, thereby forming a substantially flat bottom surface of the second end 115 of the tray 100. The bottom wall 110 may include recesses, protrusions, and/or other features configured to support the tray 100.

The outer wall 112 extends at least partially in the first direction F from an outer periphery 146 of the bottom wall 110. A transition between the outer periphery 146 of bottom wall 110 and the outer wall 112 may have a curved shape. The outer wall 112 extends from the bottom wall 110 to the first end 114 of the tray 100, and defines an outer periphery of the interior 103 of the tray 100. The outer wall 112 may extend at an angle relative to the central axis A, thereby forming a conical shaped wall. Alternatively, the outer wall 112 may extend substantially parallel to the central axis A, thereby forming a substantially cylindrically shaped wall.

The outer wall 112 may define one or more structural support elements 148. The structural support elements 148 may include recesses and/or protrusions formed on the outer wall 112, or may include components attached or connected to the outer wall 112. The structural support elements 148 are configured to provide structural support to the body 101 of the tray 100 so that during use of the tray 100, such as packaging, storing, and releasing the wax ring 10, the tray 100 maintains a rigidity. The structural support elements 148 are spaced about the outer wall 112. In an aspect, the structural support elements 148 are spaced evenly about a circumference of the outer wall 112 and are positioned toward the first end 114 of the tray 100. The structural support elements 148 may include configurations that are substantially similar to the configurations of the structural support elements 134*a* and 134*b* of the first and second flexible members 104*a* and 104*b*.

A length of the outer wall 112 in the first direction F is at least as long as a length of the first flexible member 104*a* in the first direction F, and at least as long as the second flexible member 104*b* in the first direction F. For example, an uppermost end 150 of the outer wall 112 in the first direction F is level with or above the first and second ends 126*a* and 126*b* of the first and second flexible members 104*a* and 104*b* in the first direction F. The uppermost end 150 of the outer wall 112 may extend radially outward defining an upper sealing surface 152. The upper sealing surface 152 is configured to adhere to a sealing membrane (e.g. lid 12), such as an adhesive coated paperboard or foil backing, for sealing the wax ring 10 within the tray 100. The lid 12 may be, for example, heat sealed to the upper sealing surface 152 and/or sealed to the upper sealing surface 152 by glue or other adhesive.

The inner wall 108, the bottom wall 110, and the outer wall 112 define a ring cavity 154 within the tray 100. The ring cavity 154 comprises a portion of the interior 103, and is configured to receive at least a portion of the wax ring 10 therein.

Figure 8:
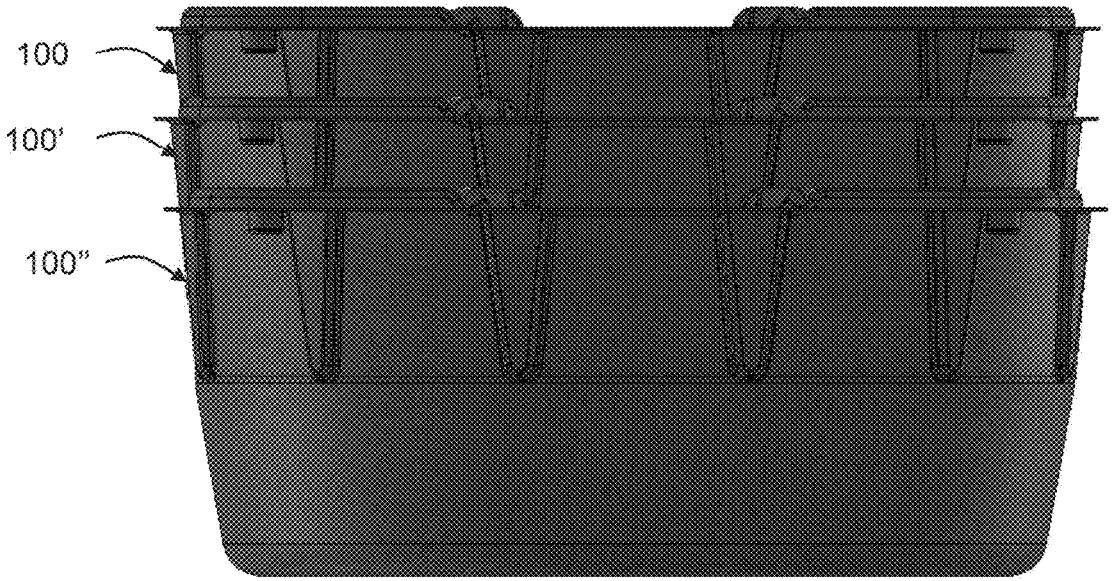
FIG. 8 illustrates several wax ring trays nested within one another, according to an aspect of this disclosure.

The wax ring tray 100 is configured to be nestable one within another when the tray 100 is empty. FIG. 8 illustrates several wax ring trays 100, 100', and 100" nested within one another, according to an aspect of this disclosure. Nesting trays 100 facilitates stacking, storage, and transport. The tapered (e.g. angled) surfaces and walls (e.g. first and second outer member surfaces 130*a* and 130*b*, first and second inner member surfaces 132*a* and 132*b*, inner wall 108, and outer wall 112) of the tray 100 can facilitate nesting of the tray 100 within like trays 100' and 100". The tray 100 can be nested by inserting the second end 116 of the tray 100 into an opening defined by the first end 115 of another tray 100'. The bottom wall 110 of the tray 100 may be positioned within the ring cavity 154 of the other tray 100'. Similarly, the first and second flexible members 104*a* and 104*b* of the tray 100' may be positioned within the first and second cavities 136*a* and 136*b*, respectively, of the tray 100. Although three trays 100, 100', and 100" are shown nested within one another, it will be appreciated that fewer or more trays can be nested together.

During packaging of the wax ring 10 within the wax ring tray 100, a wax can be hot-filled into the ring cavity 154 of the interior 103 to form the wax ring 10. The wax can be filled to a level that extends above or below a height of the ring cavity 154. In an aspect, the wax ring tray 100 may include a spacer (not shown) to space the wax ring 10 away from the first and second flexible members 104*a* and 104*b*, and to substantially prevent the wax from entering a central portion of the interior 103 between the first and second flexible members 104*a* and 104*b*. The spacer may comprise a plastic ring that extends about the outer periphery 120 of the base 102. The wax is filled at least to a height so that the wax contacts the one or more retaining elements 143 located on (or defined by) the inner wall 108. The one or more retaining elements 143 may provide a retaining force to the wax ring 10 to prevent the wax ring 10 from prematurely releasing from the ring cavity 154. The one or more retaining elements are configured to releasably retain the wax ring 10 within the wax ring tray 100.

After the wax ring 10 has been formed in the ring cavity 154, any tools or other hardware may be optionally stored within the central portion of the interior 103. The tools and hardware may include, for example, screws, nuts, bolts, wrenches, putty, or other tool or hardware used during installation of the wax ring 10.

After the wax is filled into the ring cavity 154 and any tools or other hardware components are stored within the tray 100, the lid 12 is then sealed to the upper sealing surface 152 of the outer wall 112. The central opening 124 of the base 102 provides a vent for any heat that may remain in the wax after the filling step. Similarly, heat can be vented through optional apertures formed on the first and second flexible members 104*a* and 104*b*. After sealing the lid 12, the wax ring tray 100 and wax ring 10 can be boxed and shipped.

In an aspect, the tools and hardware, or additional tools and hardware, can be stored in the outer cavity 142 defined by the base 102 and the inner wall 108. A second lid (not shown) could be sealed to the bottom wall 110 to retain the tools and hardware within the outer cavity 142 for storage and shipping.

When an installer is ready to use the wax ring 10, the lid 12 is removed from the upper sealing surface 152 of the wax ring tray 100. Any tools or hardware stored within the interior 103 can be removed so that the central portion is substantially empty. To release the wax ring 10 from the tray 100, the installer can place their fingers inside the first and second cavities 136*a* and 136*b* of the first and second flexible members 104*a* and 104*b*, respectively. Both of the first and second flexible members 104*a* and 104*b* are configured to flex between respective first and second positions. In the first position of the first flexible member 104*a* (shown in FIG. 6), the first end 126*a* is positioned radially outward relative to the first end 126*a* when the first flexible member 104*a* is in the second position. Similarly, in the first position of the second flexible member 104*b* (shown in FIG. 6), the second end 126*b* is positioned radially outward relative to the second end 126*b* when the second flexible member 104*b* is in the second position. In an aspect, the first and second flexible members 104*a* and 104*b* are biased toward their respective first positions.

After the installer has inserted their fingers into the first and second cavities 136*a* and 136*b*, the installer can transition both of the first and second flexible members 104*a* and 104*b* from their respective first positions to their respective second positions. The first and second flexible members 104*a* and 104*b* can be transitioned to their respective second positions by applying a first force to the first flexible member 104*a* in a radially inward direction, and applying a second force to the second flexible member 104*b* in a radially inward direction toward the first flexible member 104*a*. Transitioning the first and second flexible members 104*a* and 104*b* to their respective second positions reduces contact between the wax ring tray 100 and the wax ring 10, thereby releasing the wax ring 10 from the ring cavity 154. Additionally, the wax ring 10 is detached from the one or more retaining elements 143, thereby removing the force applied by the one or more retaining elements 143 onto the wax ring 10. Transitioning the first and second flexible members 104*a* and 104*b* to their respective second positions can also cause the inner wall 108 of the tray 100 to flex radially inward, thereby spacing the wall 108 away from the wax ring 10.

In an aspect, the installer could use pliers or other tools to insert into the first and second cavities 136*a* and 136*b* to transition both of the first and second flexible members 104*a* and 104*b* from their respective first positions to their respective second positions. In another alternative aspect, the installer could transition the first and second flexible members 104*a* and 104*b* by gripping each of the first and second flexible members 104*a* and 104*b* through the tray opening 113 toward the first and second ends 126*a* and 126*b*, and squeezing the ends 126*a* and 126*b* radially inwardly.

After the wax ring 10 is released from the tray 100, an installer can remove the wax ring 10 from the tray with ease. In an aspect, after the wax ring 10 has been released, an installer can flip the tray 100 upside down so that the tray opening 113 faces in a downward direction (e.g. toward the ground), and the wax ring 10 can be removed by the force of gravity. A benefit of the wax ring tray 100 is that contact between the installer and the wax ring 10 is minimized. The wax ring 10 can pop out of the wax ring tray 100 without the installer ever having to touch the wax ring 10.

Figure 9:
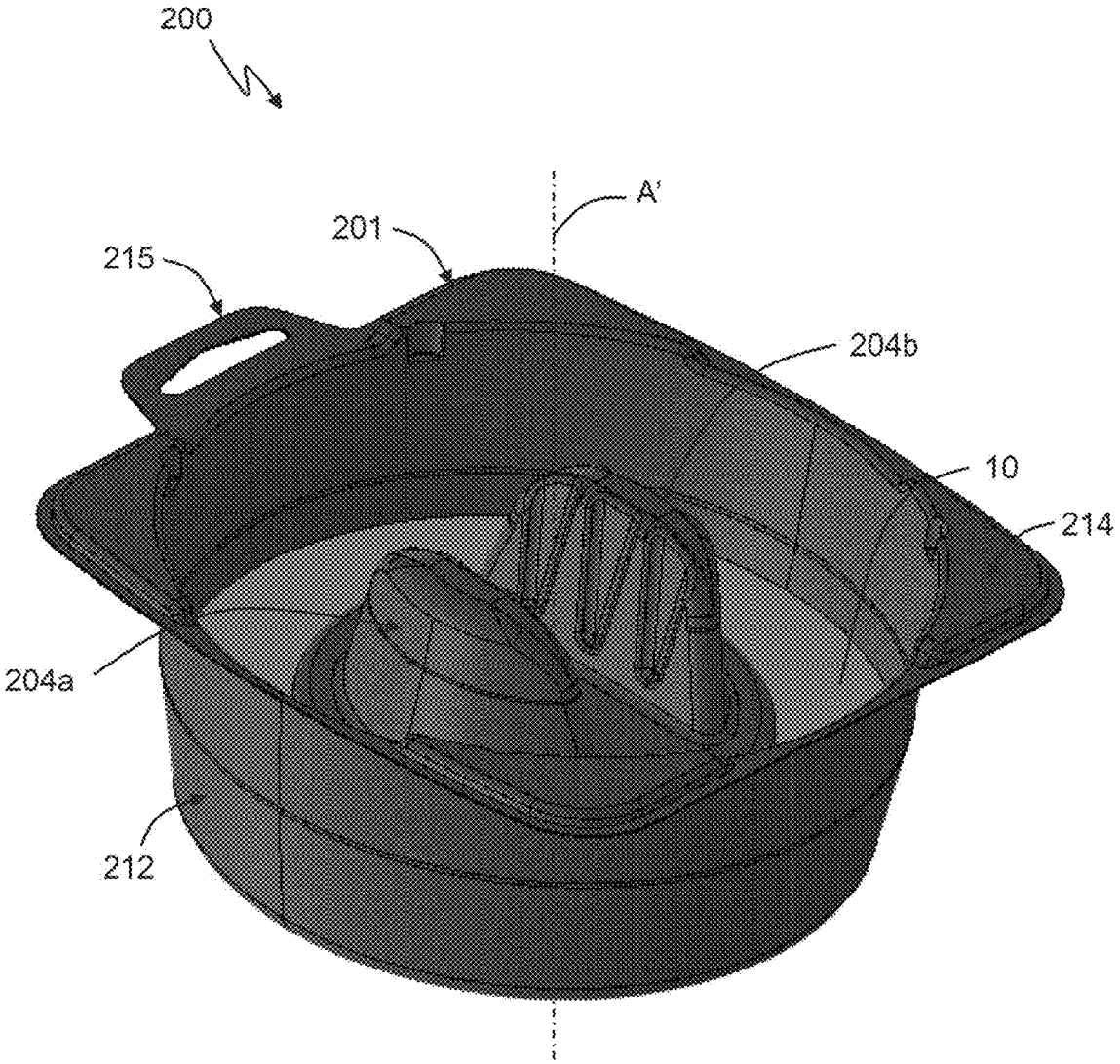
FIG. 9 illustrates a top perspective view of a second aspect of wax ring tray, according an aspect of this disclosure.
Figure 10:
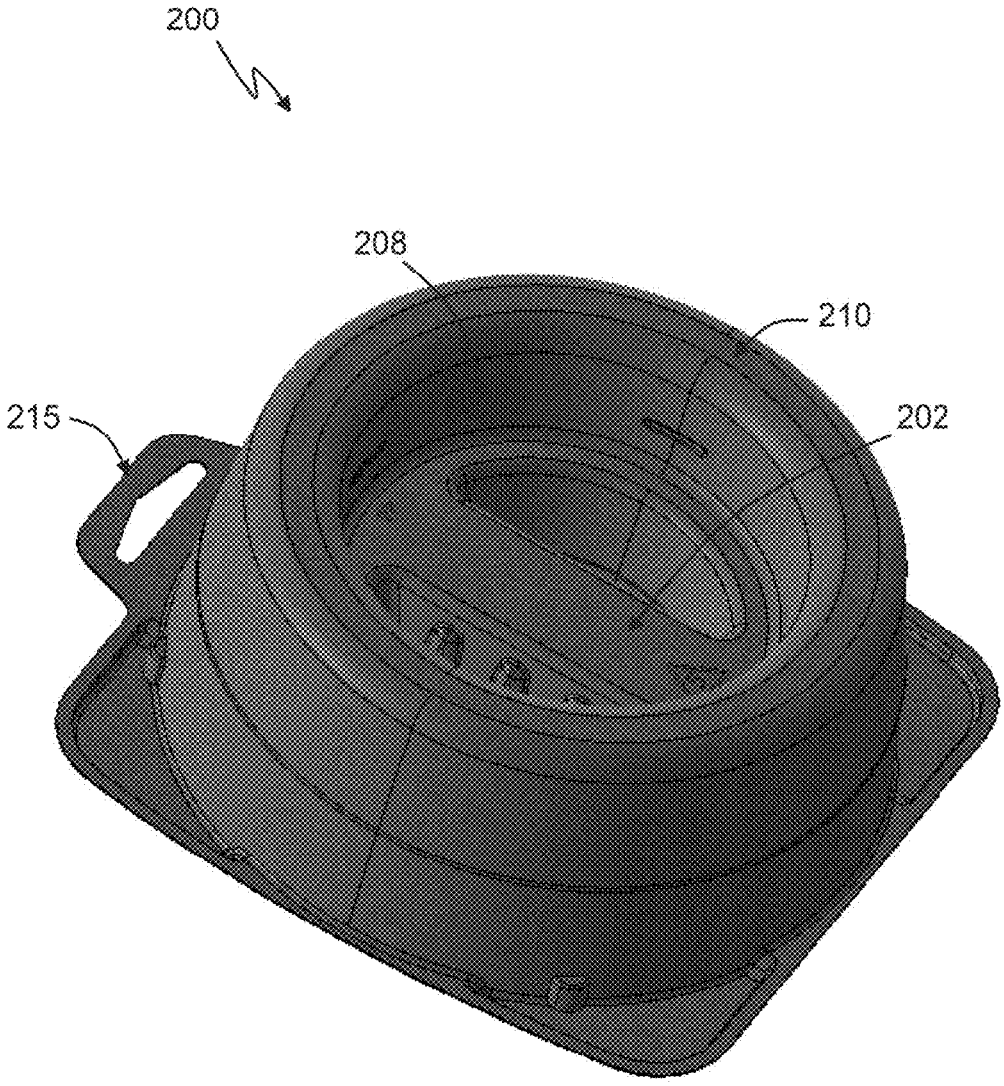
FIG. 10 illustrates a bottom perspective view of the wax ring tray shown in FIG. 9.
Figure 11:
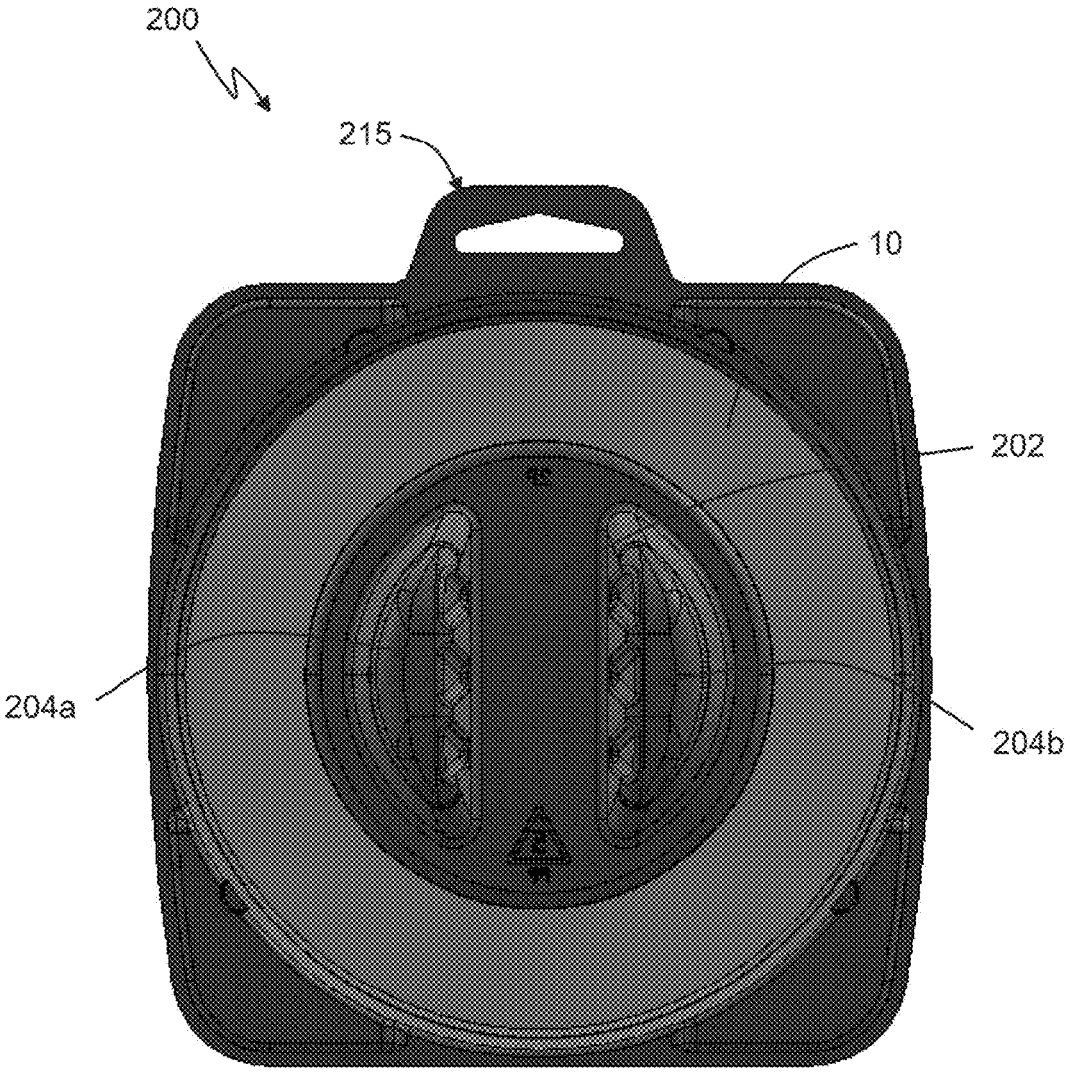
FIG. 11 illustrates a top view of the wax ring tray shown in FIG. 9.

FIGS. 9 through 11 illustrate an alternate aspect of a wax ring tray 200, according to aspects of this disclosure. Portions of the alternate aspect of the wax ring tray 200 disclosed in FIGS. 9 through 11 are similar to aspects of the wax ring tray 100 described above in FIGS. 1 through 8 and those portions function similarly to those described above. The wax ring tray 200 includes a body 201 that comprises a base 202, a first flexible member 204*a*, a second flexible member 204*b*, an inner wall 208, a bottom wall 210, and an outer wall 212. The first and second flexible members 204*a* and 204*b* can be transitioned between their respective first and second positions in a substantially similar manner as the first and second flexible members 104*a* and 104*b* of the wax ring tray 100, as described above.

The wax ring tray 200 includes a hang member 215 extending from an upper end 214. The hang member 215 can extend outward from the upper end 214 in a direction extending radially outward from a central axis A' of the wax ring tray 200. When each wax ring tray 200 is nested within a corresponding wax ring tray, the hang members 215 of the adjacent wax ring trays 200 can align in a vertical direction. The hang member 215 is configured to support the weight of the wax ring tray 200 with the wax 10 within, such that the wax ring tray 200 can be hung from, for example, a pin hook.

The outer wall 212 may be free of structural support members, thereby defining a continuous circumferential surface (e.g. a flat cylindrical surface) about the wax ring tray 200. The flat cylindrical surface can allow for labeling on the outer wall 212.

The base 202 may be free of holes extending through, such that an interior of the wax ring tray 200 does not open to an exterior of the tray 200 through the base 202. In an aspect, each of the base 202, the first and second flexible member 204*a* 204*b*, the inner wall 208, the bottom wall 210, and the outer wall 212 are free of holes, such that when a lid is applied to the upper end 214 the tray 200, the tray 200 can maintain a vacuum or a pressure within the interior.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

What is claimed is:

1. A wax ring tray configured to store a wax ring therein, the wax ring tray comprising:

a base having an upper surface and an opposing lower surface;

a first flexible member positioned radially outward from a center of the base, the first flexible member extending at least partially in a first direction from the upper surface of the base to a first end, the first flexible member defining a first cavity that has a first opening defined by the lower surface of the base; and a second flexible member positioned radially outward from the center of the base, the second flexible member extending at least partially in the first direction from the upper surface of the base to a second end, the second flexible member defining a second cavity that has a second opening defined by the lower surface of the base, wherein the first flexible member and the second flexible member are configured to transition between respective first positions and second positions, wherein in the first position of the first flexible member, the first end is positioned radially outward relative to the first end of the first flexible member in the second position, and wherein in the first position of the second flexible member, the second end is positioned radially outward relative to the second end of the second flexible member in the second position.

2. The wax ring tray of claim 1, further comprising:

an inner wall extending at least partially in a second direction from an outer periphery of the base, the second direction being opposite the first direction;

a bottom wall extending at least partially in a third direction from an outer periphery of the inner wall, the third direction being perpendicular to the first and second directions; and an outer wall extending at least partially in the first direction from an outer periphery of the bottom wall, wherein the inner wall, the bottom wall, and the outer wall form a ring cavity configured to receive the wax ring therein.

3. The wax ring tray of claim 2, wherein a length of the outer wall in the first direction is at least as long as a length of the first flexible member in the first direction, and at least as long as a length of the second flexible member in the first direction.

4. The wax ring tray of claim 2, wherein the inner wall defines at least one retaining element.

5. The wax ring tray of claim 1, wherein the first flexible member includes a first radially outermost surface, the first radially outermost surface being angularly offset from the first direction, and wherein the second flexible member includes a second radially outermost surface, the second radially outermost surface being angularly offset from the first direction, the first direction being substantially perpendicular to the upper surface of the base.

6. The wax ring tray of claim 1, wherein the first flexible member and the second flexible member are biased toward their respective first positions.

7. The wax ring tray of claim 1, wherein the first and second cavities are sized to receive at least a portion of a finger therein.

8. The wax ring tray of claim 1, wherein in the first positions of the first and second flexible members, the first and second flexible members are configured to retain the wax ring within the wax ring tray, and wherein in the second positions of the first and second flexible members the first and second members are configured to release the wax ring from the wax ring tray.

9. The wax ring tray of claim 1, wherein the wax ring tray is configured to nest within a second wax ring tray such that the first flexible member and the second flexible member nest within a corresponding first cavity of a first flexible member and a corresponding second cavity of a second flexible member, respectively, of the second wax ring tray.

10. The wax ring tray of claim 1, wherein the first flexible member is radially opposed to the second flexible member.

11. A packaging kit comprising:

a wax ring; and a wax ring tray configured to store the wax ring therein, the wax ring tray comprising:

a base having an upper surface and an opposing lower surface;

a first flexible member positioned radially outward from a center of the base, the first flexible member extending at least partially in a first direction from the upper surface of the base to a first end, the first flexible member defining a first cavity that has a first opening defined by the lower surface of the base; and a second flexible member positioned radially outward from the center of the base, the second flexible member extending at least partially in the first direction from the upper surface of the base to a second end, the second flexible member defining a second cavity that has a second opening defined by the lower surface of the base, wherein the first flexible member and the second flexible member are configured to transition between a first position and a second position, wherein in the first position of the first and second flexible members, the wax ring is retained within the wax ring tray, and wherein in the second position of the first and second flexible members, the wax ring is released from the wax ring tray.

12. The packaging kit of claim 11, wherein in the first position of the first flexible member, the first end is positioned radially outward relative to the first end of the first flexible member in the second position, and wherein in the first position of the second flexible member, the second end is positioned radially outward relative to the second end of the second flexible member in the second position.

13. The packaging kit of claim 11, wherein the wax ring comprises an ingredient that substantially prevents the wax ring from sticking to the wax ring tray.

14. The packaging kit of claim 11, wherein the wax ring tray further comprises an inner wall extending at least partially in a second direction from an outer periphery of the base, the second direction being opposite the first direction, the inner wall defining at least one retaining element configured to releasably retain the wax ring within the wax ring tray.

15. A method of removing a wax ring from the wax ring tray of claim 1, the method comprising:

transitioning the first flexible member from the first position to the second position; and transitioning the second flexible member from the first position to the second position.

16. The method of claim 15, further comprising:

inserting a first finger into the first cavity of the first flexible member;

inserting a second finger into the second cavity of the second flexible member;

applying a first force by the first finger to the first flexible member within the first cavity in a radially inward direction to transition the first flexible member from the first position to the second position; and applying a second force by the second finger to the second flexible member within the second cavity in a radially inward direction to transition the second flexible member from the first position to the second position.

* * * * *